United States Patent [19]

Itou

[11] Patent Number: 4,614,462

[45] Date of Patent: Sep. 30, 1986

[54] ROTATION DEVICE FOR A FOUNDATION PILE

[75] Inventor: Yoshitaka Itou, Ebinashi, Japan

[73] Assignee: Daido Concrete Kogyo Kabushiki Kaisha, Tokyo, Japan

[21] Appl. No.: 735,089

[22] Filed: May 17, 1985

[30] Foreign Application Priority Data

May 18, 1984 [JP] Japan ..... 59-100265

[51] Int. Cl.[4] ..... F02D 7/00

[52] U.S. Cl. ..... 405/232; 173/5; 173/145; 173/146; 192/55

[58] Field of Search ..... 405/232; 173/5, 12, 173/145, 146; 192/54, 55; 464/30, 37

[56] References Cited

U.S. PATENT DOCUMENTS

| | | | |
|---|---|---|---|
| 1,799,918 | 4/1931 | Marsden | 173/145 |
| 2,578,834 | 12/1951 | Piper | 173/146 |
| 3,420,320 | 1/1969 | Washita | 405/232 |
| 3,763,654 | 6/1973 | Matsushita | 405/232 |
| 4,195,698 | 4/1980 | Nalcagawasai | 405/232 |

FOREIGN PATENT DOCUMENTS

| | | | |
|---|---|---|---|
| 0048434 | 5/1981 | Japan | 405/232 |
| 0389210 | 5/1973 | U.S.S.R. | 173/145 |

*Primary Examiner*—Cornelius J. Husar
*Assistant Examiner*—Douglas W. Hanson
*Attorney, Agent, or Firm*—Oblon, Fisher, Spivak, McClelland & Maier

[57] ABSTRACT

A rotation device for settling a pre-molded foundation pile into the earth by imparting axial loading thereto and by imparting torque of approximately equal magnitudes to both the upper- and lowermost portions of the foundation pile. A clutch assembly comprising upper and lower pawl members is disposed on the upper end of the foundation pile. A driving rod passes through the clutch mechanism and the premolded pile. Upper and lower driving blocks of the rotation rod are faceted for nonrotationally engaging, respectively, the clutch mechanism and the lowermost portion of the foundation pile. Torque is imparted from the driving rod to the lowermost portion of the foundation pile through the lower driving block. Torque also is imparted from the driving rod through the upper driving block, the pawls of the clutch mechanism and then to the uppermost portion of the foundation pile. Because torque is imparted to the foundation pile at both the upper and lower ends thereof, twisting moments may be minimized along the length of the foundation pile. In the event of an overload, the pawl members of the clutch assembly may slip with respect to each other, thereby preventing damage to the foundation pile. Axial loading is transmitted to the foundation pile through the clutch assembly.

15 Claims, 13 Drawing Figures

ROTATION DEVICE FOR A FOUNDATION PILE

BACKGROUND OF THE INVENTION

1. Field of the Invention:

The invention relates to the insertion or installation of foundation piles into the ground, and particularly to a rotational device for accomplishing such installation.

2. Description of the Prior Art:

The installation of conventional foundation piles has previously been accomplished by drilling a hole in the ground, as by an auger, and lowering a premolded pile into the hole. After drilling the hole, loose dirt often remains in the bottom of the hole, preventing the pile from being inserted completely to the desired depth using only the weight of the pile itself. Therfore, it is necessary to rotate the pile and press it downwardly.

Therefore, in the conventional methods, a device has been attached to the head of the pile to rotate it, using the same source of power that was used for rotating the auger. In using this method, it has been difficult to transfer rotational force or torque applied to the head or upper portion of the pile through the length of the pile to its lower end. The transmission of this torque through the pile was hampered by friction of the ground against the pile, and the degree of settlement that may be achieved using this method has been limited. The problem also has become more difficult to employ with relatively long piles. In addition, the torque applied to the upper portion of the pile may cause shearing failure of the pile itself, which is usually made of concrete. The chances of such failure become greater with increasing length of the pile.

SUMMARY OF THE INVENTION

The current invention provides a means of overcoming or minimizing these and other difficulties associated with the prior art by providing a means of imparting torque both to the upper and lower portions of the pile, thereby minimizing the chances of twisting failure of the pile and facilitating the insertion thereof into the ground. A rotation rod is inserted into a hollow premolded foundation pile. The rotation rod, which receives torque from an external power source, is provided with a pair of faceted driving blocks, one of which non-rotatably engages the lower portion of the foundation pile. A clutch assembly is disposed adjacent the upper portion of the foundation pile and receives torque from the upper driving block, which also is faceted for non-rotational engagement with the clutch assembly. A fixing plate is attached to the upper face of the foundation pile and receives both axial loading and torque from the clutch assembly.

The clutch assembly is made up of upper and lower clutch members having engaging pawls for transmitting torque through their sloped engaging surfaces. The pawls are configured in such a way that they are allowed a certain amount of free relative rotational movement in the direction opposite from their engaging direction. This relative movement allows the lower clutch member to be moved with respect to the fixing plate while the upper clutch member remains fixed. The lower clutch member and the fixing plate have engageable keying members which may be engaged during this movement of the lower clutch member.

Accordingly, it is an object of this invention to provide an apparatus for transmitting torque directly to the lower portion of a foundation pile as well as to the upper portion of the pile.

It is another object of this invention to provide an apparatus for minimizing twisting moments throughout the length of a foundation pile during its installation.

It is yet another object of the current invention to provide an apparatus for minimizing the chances of failure of a foundation pile during its installation.

It is yet an additional object of this invention to provide an apparatus for assisting the installation of long foundation piles.

A further object of this invention is to provide an apparatus for making easier the installation of a foundation pile using a given axial loading.

It is another object of this invention to provide a rotational device for installing a foundation pile which accomplishes all of the above objectives.

BRIEF DESCRIPTION OF THE DRWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
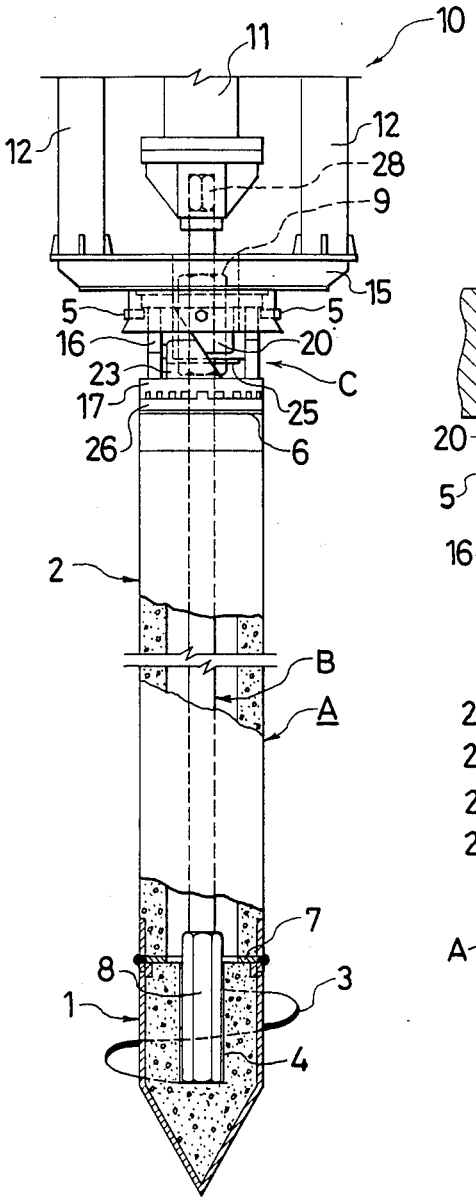
FIG. 1 is an elevation of a foundation pile, partly in section, and of the preferred embodiment of the invention.

Referring now to the drawings, wherein like reference numeral designate identical or corresponding parts throughout the several views, and more particularly to FIG. 1 thereof, there is shown a foundation pile A which comprises leading pile 1 and pre-molded concrete hollow pile 2. The leading pile 1 preferably is formed by covering the exterior of a concrete pile main body with protective steel sheet and between one and several turns of spiral screw blade 3 fixedly attached to the exterior of the steel sheet. Engaging hole 4 of leading pile 1 has sides that are faceted for being non-rotationally engaged.

The premolded concrete pile 2 is of a standard type which need not be described in detail. However, it is provided with end plates 6 and 7 on opposite ends thereof to which are attached steel shaft and spiral reinforcing bars. The upper end of the leading pile 1 and the lower end of the premolded concrete pile 2 are joined by welding.

Rotation rod B transmits torque to first and second driving blocks 9 and 8, respectively. Both first and second driving blocks 9, 8 are faceted for non-rotational engagement, yet the facets allow for relative movement axially of the rotation rod B between the driving blocks and the members to which they engage.

Figure 2:
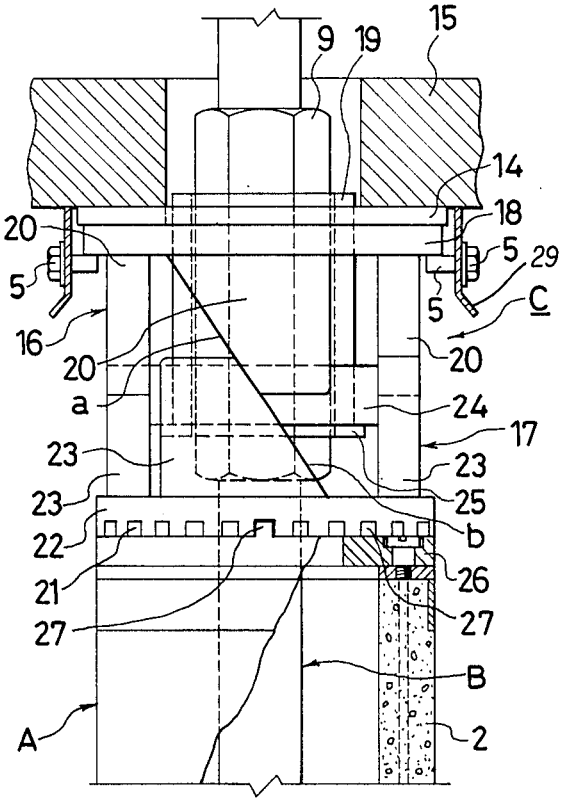
FIG. 2 is an enlarged elevation, partly in section, of a portion of FIG. 1.

The lower or second driving block 8 non-rotationally engages the engaging hole 4 of leading pile 1 and comprises means for transmitting torque from rotation rod B to leading pile 1. When the rotation rod B is inserted into the foundation pile, as seen in FIG. 2, the upper or first driving block 9 is disposed above the upper end of the foundation pile. Extending upwardly beyond the upper driving block 9 is an upper portion of the driving rod B, which terminates in a faceted end 28 for receiving driving torque.

Clutch assembly C is drivingly located between the head of the foundation pile A and rotational pressing mechanism 10, which is made up of hydraulic auger 11 for transmitting torque to rotation rod B and hydraulic cylinder means 12 and pressing body 15 for transmitting axial loading to clutch assembly C.

As shown in FIGS. 5–8, clutch assembly C comprises first or upper clutch member 16 and second or lower clutch member 17. Upper clutch member 16 includes engaging cylinder 19, an interior bore of which is faceted for non-rotationally receiving upper driving block 9 of rotation rod B. Fixed on the external circumference of engaging cylinder 19 is washer plate 18. Washer plate 18 has a flat upper surface for receiving lubricated reception plate 14, which provides an interface between washer plate 18 and pressing body 15 (FIG. 2).

The first clutch member 16 further comprises a plurality of upper or first pawls 20, circumferentially fixed on the underside of washer plate 18. Each upper pawl 20 has a sloped driving face "a" tapering downwardly toward the tip of the pawl.

Lower clutch member 17 comprises a similar number of matching lower or second pawls 23 having inclined driving faces "b" that may drivingly engage the sloped driving faces "a" of the upper clutch member 16. The lower pawls 23 are fixed on ring body 22, which also comprises a plurality of radially-oriented key grooves 21 circumferentially disposed on the underside of the ring body 22.

Lower clutch member 17 further comprises a guide cylinder 24, attached to the inside surfaces of lower pawls 23. This attachment may be by means of bolts, as illustrated. Guide cylinder 24 loosely contacts the outer circumference of engaging cylinder 19. Upper clutch member 16 further comprises a stopping ring 25 affixed to the lower face of engaging cylinder 19, the stopping ring 25 having a larger diameter than the inside diameter of guide cylinder 24. Accordingly, stopping ring 25 and guide cylinder 24 serve to limit relative axial displacement of the upper and lower clutch members 16 and 17 in one direction.

Figure 6:
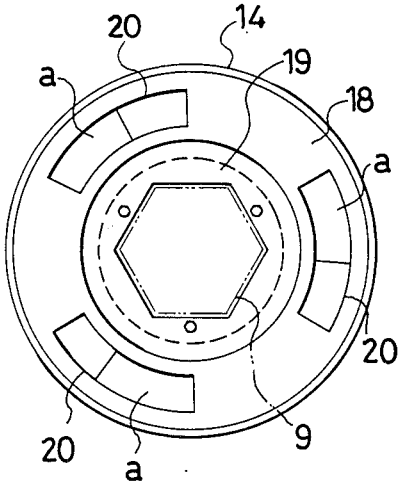
FIG. 6 is a bottom view of the upper or first clutch member before incorporation into the clutch assembly, with the upper or first driving block of the rotation rod shown in phantom.
Figure 7:
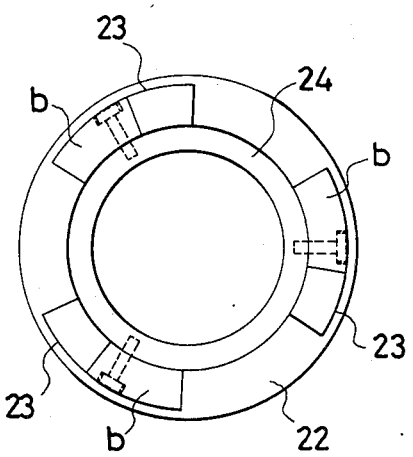
FIG. 7 is a plan view of the lower or second clutch member before incorporation into the clutch assembly.
Figure 8:
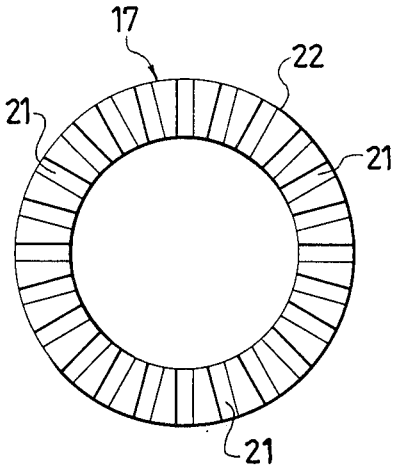
FIG. 8 is a bottom view of the lower or second clutch member.

During assembly, the upper clutch member 16 and lower clutch member 17 are assembled with the pawls 20 and 23 facing each other and with the engaging cylinder 19 passing through guide cylinder 24. Stopping plate 25 is then fixed to the underside of engaging cylinder 19 by bolts, as illustrated, so that the upper and lower clutch members will not be separated from each other. As shown in FIGS. 6 and 7, the upper and lower pawls are configured such that there is provided a certain amount of free relative rotation between the upper and lower clutch members in the non-engaging direction of the upper and lower pawls. That is, when the sloping driving surfaces of the pawls are engaged, the pawls of the lower clutch member, for example, may be "backed away" from the pawls of the upper clutch member. Accordingly, a certain amount of free play is provided between the upper and lower clutch member, both in the rotational and axial directions.

Figure 3:
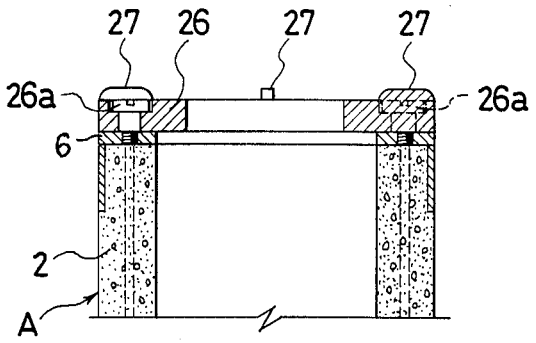
FIG. 3 is an elevational cross-section illustrating the attachment of the fixing plate to the upper portion of the foundation pile.
Figure 4:
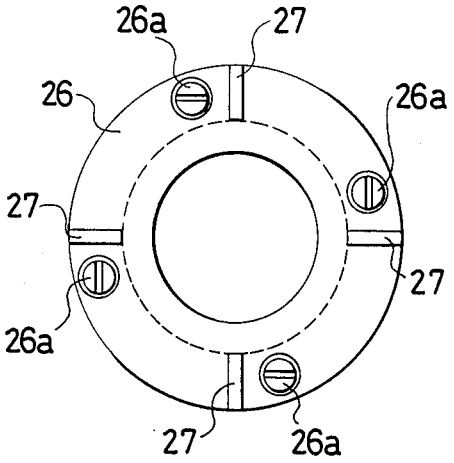
FIG. 4 is a plan view of FIG. 3.

As shown in FIGS. 3 and 4, the ring shaped fixing plate 26 is fixed to the head of the foundation pile A by bolts **26*a* threadedly engaged with threaded holes in the end plate 6. The upper surface of fixing plate 26 is provided with a plurality of radially-oriented keys 27 circumferentially disposed about the fixing plate 26. The keys 27 are configured so as to engage with key grooves 21 of ring body 22 of the lower clutch member 17. Advantageously, the number of key grooves 21 is greater than the number of keys, so that a minimal rotation of ring body 22 will serve to mate the keys 27 and key grooves 21**. The installation and use of the current invention will now be described.

Fixing plate 26 is attached to the upper face of foundation pile A, rotation rod B is inserted into the foundation pile A, and the lower driving block 8 is non-rotationally engaged within the engaging hole 4 of leading pile 1. Driving block 9 at the upper part of rotation rod B at this point is disposed above the upper end of the foundation pile A. Clutch assembly C is attached to the underside of rotational pressing mechanism 10 using collar 29, which is fixed to the underside of pressing body 15 thereof (FIG. 2). Pin bolts 5 protrude through collar 29 and beneath washer plate 18, as shown.

Figure 5:
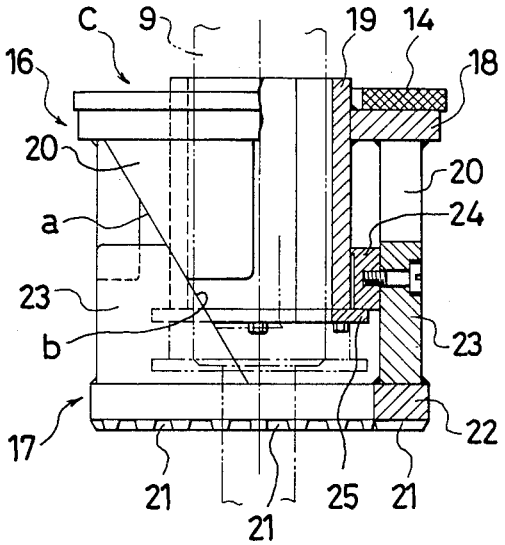
FIG. 5 is an elevation, partly in section, of the clutch assembly with the rotation rod and its upper driving block shown in phantom and with a second position of the engaging cylinder with respect to the lower clutch member also shown in phantom.
Figure 9:
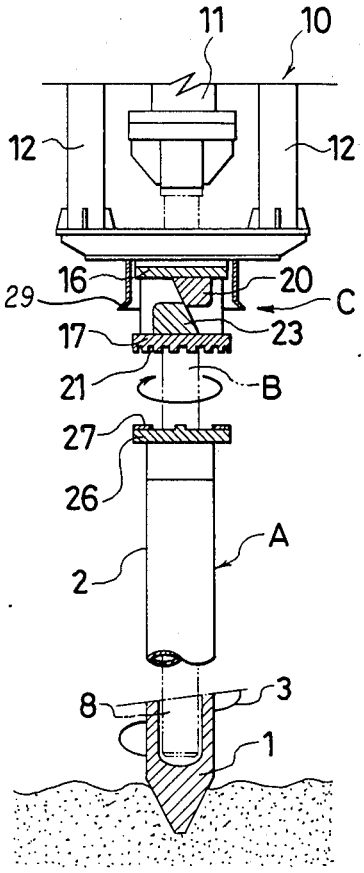
FIGS. 9–12 illustrate the various sequential configurations of the rotation device in preparation for the installation of a foundation pile.

Next, the foundation pile A is lifted, and rotation rod B, protruding upwardly from the foundation pile A, is inserted from the lower side of the clutch mechanism C. The driving block 9 is engaged into the engaging cylinder 19 of the upper clutch member 16, and the faceted end 28 of the rotation rod B is connected to the auger 11. At this stage, lower clutch member 17 decends of its own weight as shown in FIGS. 5 and 9, and the guide cylinder 24 contacts the stopping plate 25. The clutch assembly C is in the state of maximum relative axial movement. In this state, the upper and lower pawls 20, 23 are left in the condition of contacting each other.

Figure 10:
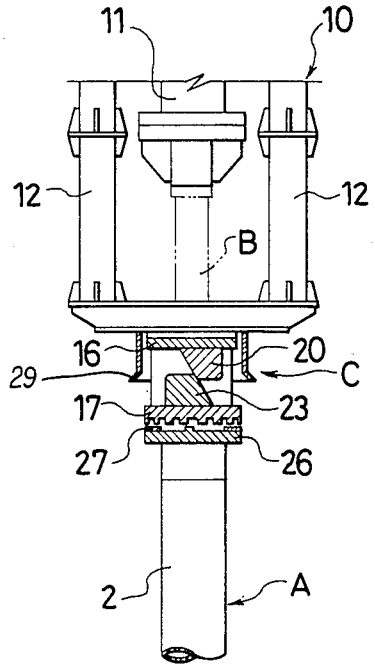
Figure 11:
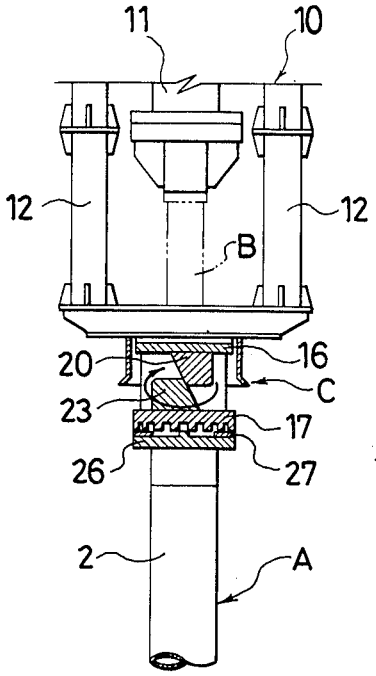

Then, the hydraulic cylinder means 12 are extended as shown in FIG. 10 to move the clutch mechanism C to a location just before the key grooves 21 on the underside of lower clutch member 17 engage the keys 27 on the fixing plate 26. Then, the lower clutch member 17 is rotated in the direction of the arrow shown in FIG. 11 so that the key grooves 21 match with the keys 27.

Figure 12:
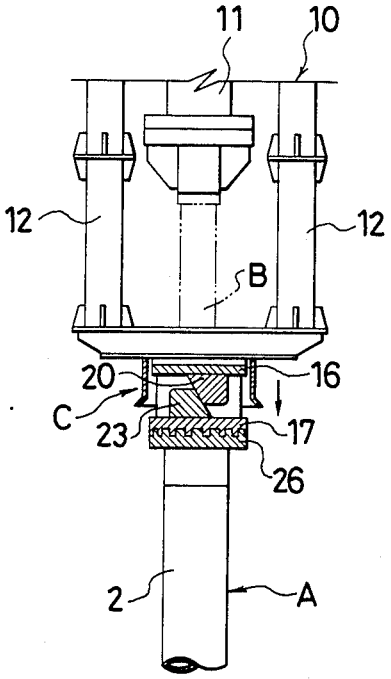
Figure 13:
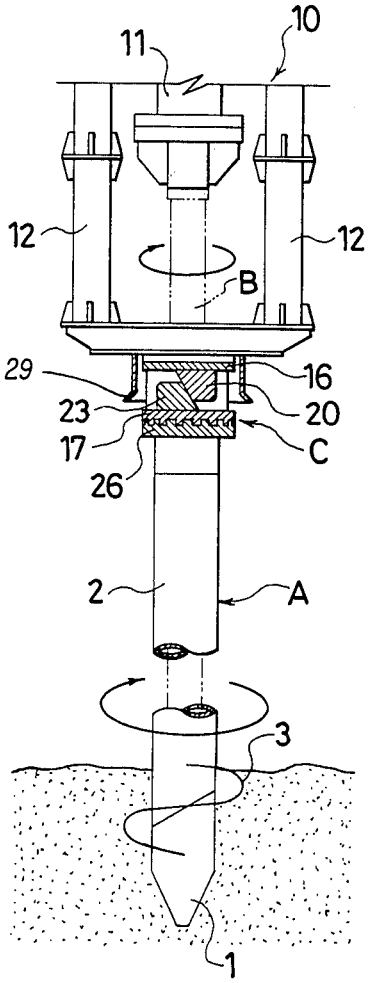
FIG. 13 illustrates the configuration of the rotation device during installation of a foundation pile.

Then, as shown in FIG. 12, the hydraulic cylinder means 12 are extended and the key grooves 21 and keys 27 engage. Hydraulic cylinder means 12 are then further extended to lower the upper clutch member 16 such that the inclined surfaces a and b of the pawls 20 and 23 will contact each other.

Then, the wire (not shown) for lifting the rotational pressing mechanism 10 is loosened, to impose the weight through the clutch assembly C to the upper part of the foundation pile A.

In this condition, rotation of auger 11 will drive rotation rod B, and the rotational force is transferred through driving block 8 to the lower end of the foundation pile 8. Rotational force is also transferred to the upper portion of the pile through the diving block 9, upper clutch member 16, lower clutch member 17, and fixing plate 26. Accordingly, the foundation pile A will be rotated by torque applied to both its upper and lower ends. It is settled into the ground by the action of the spiral screw blade 3 at the leading pile. In this case, it is necessary to keep the hanging wire continuously loosened in accordance with the settlement rate of the foundation pile, so that the weight of the rotational pressing mechanism 10 is maintained on the head of the foundation pile. After completion of the installation or settlement of the foundation pile, the rotational pressing mechanism 10 will be lifted and the rotation rod B pulled out.

At this time, if it is desired to insert the foundation pile deeper, another foundation pile may be added to the top of the already inserted pile, the rotation rod may be added with an additional rotation rod, and the operation as stated above may be repeated.

During the settlement of the foundation pile A, if the friction from the earth becomes too great and rotation rod B twists such that the torque acting on the head of the pile becomes too large, the rotational force imparted to the foundation pile A tends to act collectively on the upper portion. However, under such conditions the torque transmitted through the clutch mechanism may be thought of as exceeding the capacity of the clutch mechanism, and pawls 20 and 23 will slip respectively along their sloped driving faces a and b. The upper part of the rod B that engages the upper clutch member 16 may elastically deform against the lower part thereof in the direction of rotation. As a result, almost similar rotational forces are endowed to the leading pile 1 at the lower part of the foundation pile A and to the upper part of the pile. Therefore, failure by abnormal twisting of the foundation pile will be prevented.

Accordingly, the invention comprises a clutch assembly having upper and lower clutch members. Each clutch member has pawls for transmitting torque through sloped surfaces and which are able to move freely with respect to each other for certain distances in both rotational and axial directions. A fixing plate attached to the head of the foundation pile allows the clutch assembly to be attached and removed and freely engaged therewith. A rotation rod having faceted driving blocks for engaging the lower part of the foundation pile and the upper clutch member transmits torque to the foundation pile such that, through the cutting action of the spiral screw blade, the settlement or installation of the pile can be performed easily without vibration and noise. Torque is transmitted to the foundation pile at both the upper and lower portions thereof, resulting in almost no twisting moment within the foundation pile, even when the friction from the earth is increased. Accordingly, breakage of the foundation pile can be prevented.

Furthermore, the current invention provides a great advantage inasmuch as the engaging pawls of the clutch are free to slide against each other through their mutual inclined driving faces, and the fixing plate of the foundation pile may be freely engaged and disengaged from the clutch by moving the clutch to its proper rotational position for such engagement. Engagement of the upper part of the rotation rod to the foundation pile and the upper clutch member may be made very easily and surely, thereby allowing not only efficient set up of the device for transmitting torque to both of the lower and upper ends of the foundation pile, but also transmitting torque of similar magnitudes to both the upper and lower parts of the foundation pile even in the case of increased frictional force from the earth. Accordingly, the device can perform basic settlement or installation, allowing for sure and easy operation in installing long and large piles or performing work under large frictional pressures from the earth.

Obviously, numerous modifications and variations of the present invention are possible in light of the above teachings. It therefore is to be understood that within the scope of the appended claims, the invention may be practiced otherwise than as specifically described herein.

What is claimed as new and desired to be secured by Letters Patent of the United States is:

1. Apparatus for installing a foundation pile into the ground comprising:

a clutch assembly having first and second clutch members, said first and second clutch members respectively comprising first and second pawl means for transmitting torque therebetween by contact between respective sloped surfaces thereof;

a fixing plate, mountable on an upper portion of said foundation pile, engageable with said clutch assembly, and comprising means for transmitting torque from said clutch assembly to said upper portion of said foundation pile; and a rotation rod comprising first and second driving blocks axially spaced thereon, said first driving block comprising means for transmitting torque from said rotation rod to said clutch assembly, said second driving block comprising means for non-rotationally engaging a lower portion of said foundation pile and for transmitting torque from said rotation rod to said lower portion of said foundation pile.

2. The apparatus as claimed in claim 1, wherein said first and second pawl means are configured to allow for relative rotational motion therebetween in a non-engaging direction such that a given amount of such relative rotational motion will disengage said first and second pawl means.

3. The apparatus as claimed in claim 1, wherein said first clutch member further comprises an engaging cylinder non-rotatably couplable to and about said first driving block and connecting means for transmitting torque from said engaging cylinder to said first pawl means.

4. The apparatus as claimed in claim 3, wherein said connecting means comprises an annular washer plate fixed on an outer circumference of said engaging cylinder, said first pawl means being fixed on a lower surface of said annular washer plate.

5. The apparatus as claimed in claim 4, said clutch assembly further comprising means for transmitting axial loading and torque to said fixing plate, said washer plate further comprising a flat upper surface, said apparatus further comprising reception plate means for receiving said axial loading, for rotationally engaging said flat upper surface of said washer plate, and for transmitting said axial loading thereto.

6. The apparatus as claimed in claim 3, wherein said second clutch means is operatively disposed between said first clutch member and said fixing plate and comprises means for transmitting said axial loading and torque thereto.

7. The apparatus as claimed in claim 3, said first and second clutch members being relatively movable in an axial direction of said rotation rod and comprising stop means for limiting said relative axial movement thereof.

8. The apparatus as claimed in claim 3, wherein said engaging cylinder and said first driving block are relatively movable in an axial direction of said rotation rod.

9. The apparatus as claimed in claim 8, wherein said engaging cylinder and said first driving block are non-rotatably coupled by facets thereon.

10. The apparatus as claimed in claim 1, wherein said second clutch member further comprises a ring body, a lower surface of said ring body being engageable with said fixing plate, said second pawl means being fixed on an upper surface of said ring body.

11. The apparatus as claimed in claim 10, said first and second clutch members being relatively movable in an axial direction of said rotation rod, wherein said lower surface of said ring body further comprises first key means, and said fixing plate further comprises second key means for engagement with said first key means.

12. The apparatus as claimed in claim 11, wherein said first clutch member further comprises engaging means for engaging said second clutch member for guiding said relative motion of said first and second clutch members, said second clutch member further comprising a guide cylinder fixed on said second pawl means and contactingly disposed about said engaging means, said guide cylinder and said engaging means being freely movable with respect to each other in their circumferential and axial directions.

13. The apparatus as claimed in claim 12, said clutch assembly comprising means for receiving both axial loading and torque and for transmitting said axial loading and torque to said fixing plate.

14. The apparatus as claimed in claim 1, said clutch assembly being surroundingly disposed about said rotation rod, an upper portion of said rotation rod extending axially beyond said first driving block in the direction away from said second driving block, said upper portion of said rotation rod comprising means for receiving torque, wherein said clutch assembly further comprises a flat face for receiving axial loading and wherein said clutch assembly comprises means for transmitting both said torque and said axial loading to said first and second pawl means and thence to said fixing plate.

15. The appartus as claimed in claim 1, wherein said second driving block comprises facets for transmitting torque to said lower portion of said foundation pile.

* * * * *